US006463911B1

(12) United States Patent
Treusch et al.

(10) Patent No.: US 6,463,911 B1
(45) Date of Patent: Oct. 15, 2002

(54) FUEL PRESSURE DAMPER

(75) Inventors: Christopher Treusch, St. Clair Shores, MI (US); Paul Joseph Hrivnak, Carleton, MI (US); Paul Joseph Vlahakis, Ann Arbor, MI (US); Robert Eugene Wattleworth, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/178,294

(22) Filed: Jun. 24, 2002

Related U.S. Application Data

(63) Continuation-in-part of application No. 10/046,591, filed on Jan. 14, 2002.

(51) Int. Cl.[7] ..... F02M 41/00

(52) U.S. Cl. ..... 123/467; 123/456; 29/890.053; 29/890.06; 138/28

(58) Field of Search ..... 123/467, 468, 123/469, 456; 29/402.02, 402.05, 890.08, 890.032, 890.053, 890.054, 238, 515, 890.06; 138/28, 30, DIG. 11; 251/356

(56) References Cited

U.S. PATENT DOCUMENTS

| | | | | | |
|---|---|---|---|---|---|
| 3,620,651 | A | * | 11/1971 | Hufton | 417/436 |
| 3,680,189 | A | * | 8/1972 | Noren | 29/890.032 |
| 5,216,809 | A | * | 6/1993 | Abbott et al. | 29/890.08 |
| 5,575,262 | A | * | 11/1996 | Rohde | 123/467 |
| 5,617,827 | A | * | 4/1997 | Eshleman et al. | 123/456 |
| 5,896,843 | A | * | 4/1999 | Lorraine | 123/467 |
| 5,954,234 | A | * | 9/1999 | Connan et al. | 222/94 |
| 6,199,673 | B1 | * | 3/2001 | Wach | 188/322.18 |
| 6,205,979 | B1 | * | 3/2001 | Sims, Jr. et al. | 123/456 |
| 6,314,942 | B1 | * | 11/2001 | Kilgore et al. | 123/467 |
| 6,321,719 | B1 | * | 11/2001 | Schwegler | 123/467 |
| 6,390,131 | B1 | * | 5/2002 | Kilgore | 138/30 |

* cited by examiner

*Primary Examiner*—Carl S. Miller
(74) *Attorney, Agent, or Firm*—John E. Kajander

(57) ABSTRACT

A tubular fuel pressure damper for use in a fuel rail. The tubular fuel pressure damper includes a first and second end and an inner surface defining a cavity. The first and second ends of the fuel pressure damper are closed by crimping to form contact areas. The contact areas may be additionally sealed by welding, soldering or other means.

18 Claims, 3 Drawing Sheets

FUEL PRESSURE DAMPER

This is a continuation-in-part of application Ser. No. 10/046,591, filed Jan. 14, 2002.

FIELD OF THE INVENTION

The present invention relates generally to fuel pressure dampers, and more particularly to a low cost fuel pressure damper and a method of manufacturing fuel pressure dampers.

DISCLOSURE INFORMATION

Conventional methods of sealing the ends of a fuel pressure damper tube include plugging, capping or crimping the ends of the tube.

Plugging or capping the ends of the fuel pressure damper tube require additional components and tight dimensional tolerances for the fuel pressure damper tube and mating components to allow proper joining and sealing. Crimping the end of the fuel pressure damper tube has fewer dimensional requirements, but the crimping typically changes the profile of the tube at each end. Profile changes result in difficult weld geometry or a wider cross section at the ends of the tube. The change in the profile resulting from crimping also produce packaging concerns which may require a larger diameter fuel rail tube and hence greater associated material expenses.

It would be desirable, therefore, to provide an improved method of sealing the ends of a fuel pressure damper tube that overcomes the need for additional components and tight dimensional tolerances in the case of plugging and capping or the need to address the issues associated with profile end changes that result from crimping such as difficult weld geometry, a wider cross section at the ends of the tube or packaging.

SUMMARY OF THE INVENTION

The present invention overcomes the disadvantages of conventional crimping approaches by providing a method of crimping the ends of the fuel pressure damper tube such that a substantially U-shaped sealing channel is formed.

It is an object and advantage that the present invention results in an end view profile in which the crimped portion of the fuel pressure damper does not exceed the cross-section of the fuel rail tube. Therefore, it is not necessary to accommodate the end closure of the fuel pressure damper with a larger diameter fuel rail.

These and other advantages, features and objects of the invention will become apparent from the drawings, detailed description and claims, which follow.

DESCRIPTION OF THE PREFERRED EMBODIMENT(S)

Figure 1:
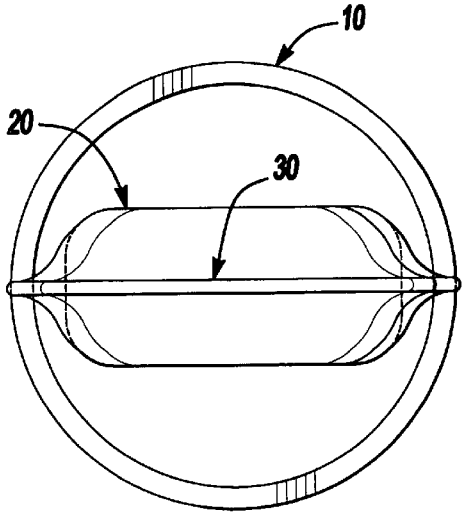
FIG. 1 is an end view of a tubular fuel pressure damper with end crimped resulting in a cross-section exceeding the diameter of a given fuel rail tube.

Referring now to the drawings, FIG. 1 illustrates the relative size of a fuel rail 10 to a fuel pressure damper tube 20 suitable for damping objectionable noise, vibration and harshness in the fuel system. The general relation of an optimized fuel press damper to a given fuel rail is also represented in this figure. Note the result of an uncontrolled (flat) crimp 30 on a fuel pressure damper 20. An uncontrolled crimp 30 on the optimized fuel pressure damper 20 results in a fuel pressure damper 20 which is too big to fit into the fuel rail 10. Shrinking the fuel damper so that the crimp does not exceed the fuel rail inner diameter results in an un-optimized damper with too little damping capacity or inefficient damping properties.

Figure 2:
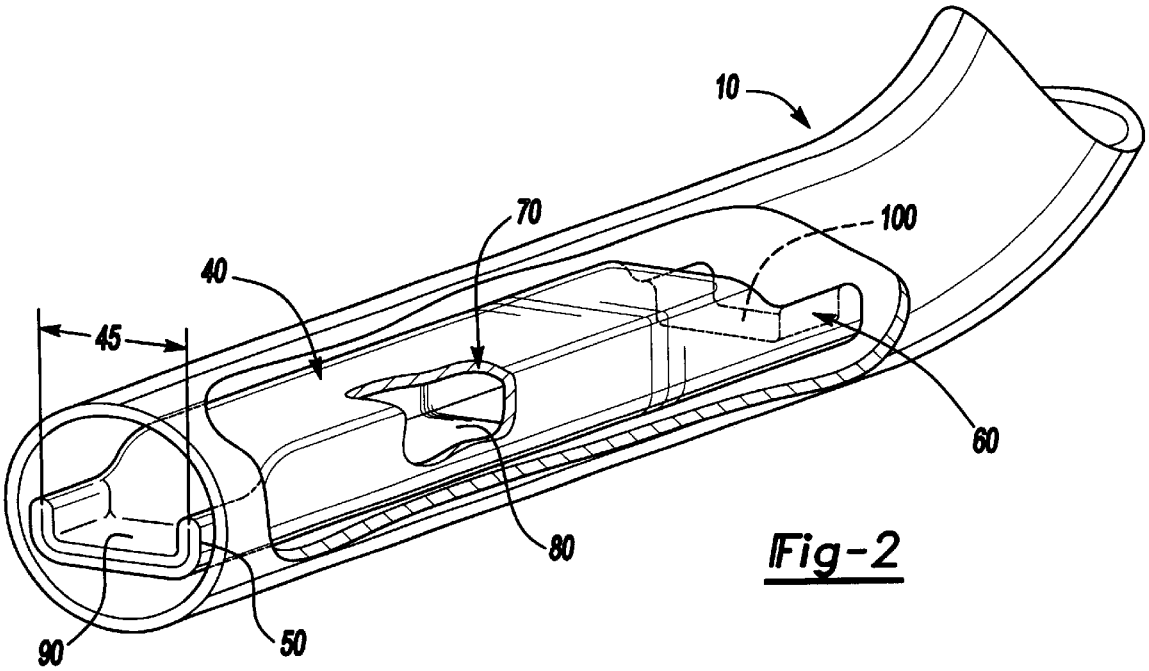
FIG. 2 is a perspective view of a tubular fuel pressure damper with a substantially rectangular cross section and crimped ends which form a substantially U-shaped channel that does not exceed the diameter of a given fuel rail tube.

FIG. 2 shows perspective view of an optimized tubular fuel pressure damper having a rectangular cross-section and residing in a fuel rail 10. The fuel pressure damper includes a damper body 40, having a damper width 45, a first end 50 and a second end 60 and an inner surface 70 defining a cavity 80, wherein the first end 50 and second end 60 are formed by the inner surface 70 in contact with itself in a first contact area 90 and a second contact area 100 such that the contact areas 90 and 100 form seals, further wherein said first end 50 and second end 60 do not exceed the damper width 45.

IN FIG. 2 the fuel pressure damper has its two ends 50 and 60 crimped resulting in substantially U-shaped contact areas 90 and 100 at each end. The substantially U-shaped crimped ends 50 and 60 produce a seal and a profile that does not exceed the damper width 45. This particular embodiment employs a substantially rectangular cross-section where two sides are substantially wider than two other sides, resulting in improved damping of certain vibrational modes over cylindrical or other cross-sections. Note that the ends 50 and 60 do not substantially exceed the damper width—for the purposes of this invention, to substantially exceed means to exceed the inner diameter of a fuel rail 10.

The fuel pressure damper can be made of tubular steel or plastic treated appropriately to seal against various fuels and fuel additives. The Fuel pressure damper may be made from seamed or seamless tube stock, having two ends and an inner surface defining a cavity. The tube ends are each crimped. When crimped sufficiently, the crimping on the two ends results in an airtight cavity, no other sealing mechanism may be necessary.

Figure 3:
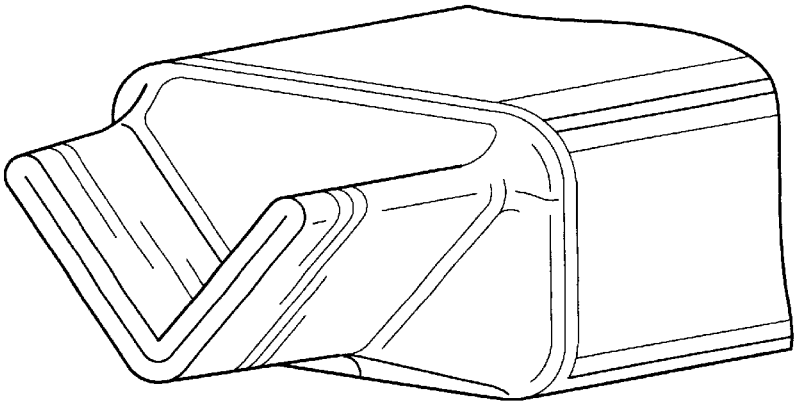
FIG. 3 is a perspective view of a fuel pressure damper with substantially V-shaped ends.

In FIG. 3, an alternative crimp design is illustrated which results in a substantially V-shaped or cross-shaped end.

Figure 4:
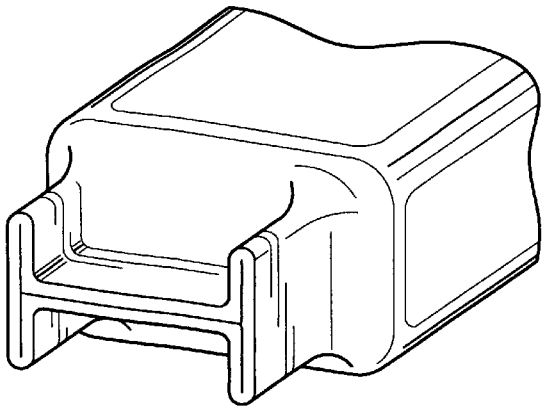
FIG. 4 is a perspective view of a fuel pressure damper with substantially H-shaped ends.

In FIG. 4, the substantially H-shaped end is illustrated.

Figure 5:
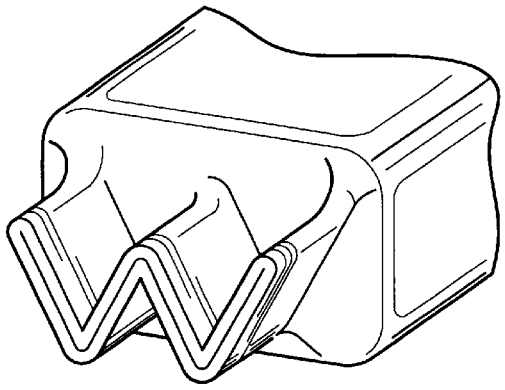
FIG. 5 is a perspective view of a fuel pressure damper with substantially W-shaped ends.

FIG. 5 shows an alternative crimp which results in a substantially W-shaped end.

Figure 6:
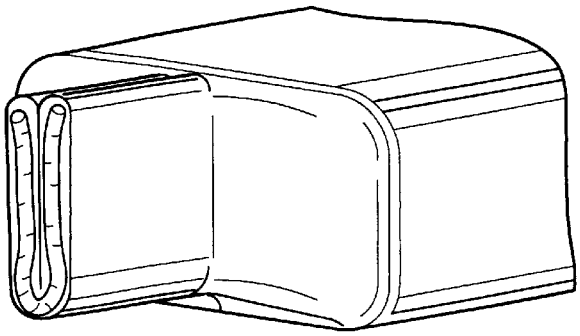
FIG. 6 is a perspective view of a fuel pressure damper with welding, soldering, brazing or adhesive applied after flattening the crimp of a substantially V-shaped end.

FIG. 6 shows supplemental sealing 150 on the contact areas 90 and 100 formed when a crimp is flattened. Note that this supplemental sealing can be carried out by the invention on all of the various shaped crimp ends. The ends may also be sealed by welding, brazing, soldering or by application of a fuel resistant sealant. The manner in which the ends are crimped and flattened results in an end view profile of the fuel pressure damper in which the crimped and flattened portions do not substantially exceed the cross-section of the fuel pressure damper. For the purposes of this invention, the crimped and flattened ends of a fuel pressure damper would substantially exceed the cross-section of the fuel pressure damper if it would not fit inside a fuel rail. The tubular fuel pressure damper may also have triangular or oval cross-sectional geometries.

Figure 7:
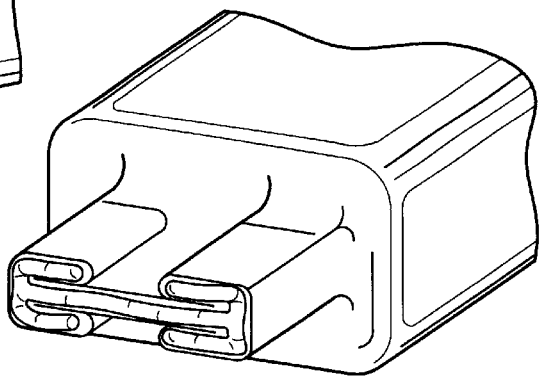
FIG. 7 is a perspective view of a fuel pressure damper with welding, soldering, brazing or adhesive applied after flattening the crimp of a substantially H-shaped end.

FIG. 7 illustrates a flattened H-shaped crimp, with supplemental sealing material included.

Figure 8:
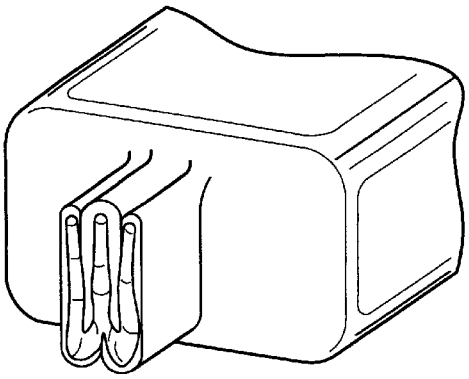
FIG. 8 is a perspective view of a fuel pressure damper with welding, soldering, brazing or adhesive applied after flattening the crimp of a substantially W-shaped end.

FIG. 8 shows a flattened W-shaped crimp, with supplemental sealing material included.

Figure 9:
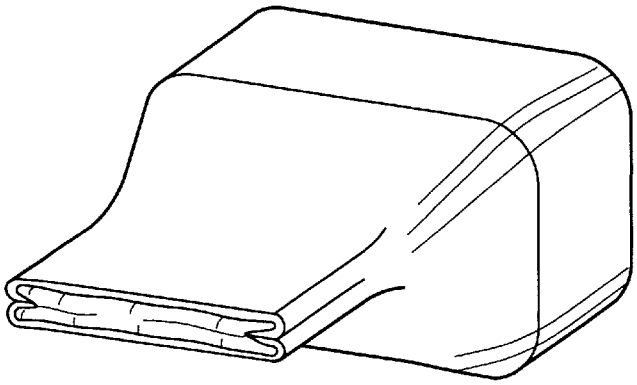
FIG. 9 is a perspective view of a fuel pressure damper with welding, soldering, brazing or adhesive applied after flattening the crimp of a substantially X-shaped end.

FIG. 9 shows a flattened X-shaped crimp, with supplemental sealing material included.

Figure 10:
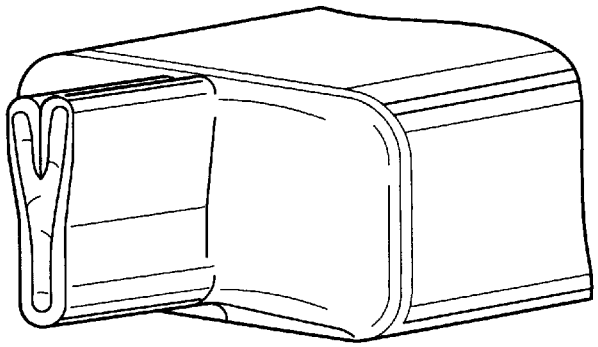
FIG. 10 is a perspective view of a fuel pressure damper with welding, soldering, brazing or adhesive applied after flattening the crimp of a substantially Y-shaped end.

FIG. 10 shows a flattened Y-shaped crimp, with supplemental sealing material included.

Figure 11:
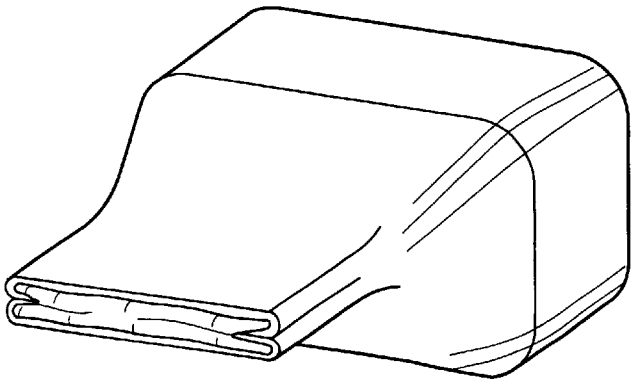
FIG. 11 is a perspective view of a fuel pressure damper with welding, soldering, brazing or adhesive applied after flattening the crimp of a substantially Z-shaped end.

FIG. 11 shows a flattened Z-shaped crimp, with supplemental sealing material included.

Various other modifications to the present invention may occur to those skilled in the art to which the present invention pertains. Other modifications not explicitly mentioned herein are also possible and within the scope of the present invention. It is the following claims, including all equivalents, which define the scope of the present invention.

What is claimed is:

1. A fuel pressure damper for use in a fuel rail comprising:

(a) a damper body, having a damper width;

(b) an inner surface defining a cavity;

(c) first and second ends, wherein said first and second ends are formed by said inner surface in contact with itself in at least a first and second contact area such that said contact areas form seals, further wherein said first and second ends do not substantially exceed said damper width, further wherein said contact areas substantially form a V-shape.

2. A fuel pressure damper according to claim 1, wherein said contact areas that substantially form a V-shape are flattened.

3. A fuel pressure damper according to claim 2, wherein said flattened contact areas are sealed by soldering.

4. A fuel pressure damper according to claim 2, wherein said flattened contact areas are sealed by crimping.

5. A fuel pressure damper according to claim 2, wherein said flattened contact areas are sealed by welding.

6. A fuel pressure damper according to claim 2, wherein said flattened contact areas are sealed by adhesive.

7. A fuel pressure damper for use in a fuel rail comprising:

(d) a damper body, having a damper width;

(e) an inner surface defining a cavity;

(f) first and second ends, wherein said first and second ends are formed by said inner surface in contact with itself in at least a first and second contact area such that said contact areas form seals, further wherein said first and second ends do not substantially exceed said damper width, further wherein said contact areas substantially form a H-shape.

8. A fuel pressure damper according to claim 7, wherein said contact areas that substantially form a H-shape are flattened.

9. A fuel pressure damper according to claim 8, wherein said flattened contact areas are sealed by soldering.

10. A fuel pressure damper according to claim 8, wherein said flattened contact areas are sealed by crimping.

11. A fuel pressure damper according to claim 8, wherein said flattened contact areas are sealed by welding.

12. A fuel pressure damper according to claim 8, wherein said flattened contact areas are sealed by adhesive.

13. A fuel pressure damper for use in a fuel rail comprising:

(g) a damper body, having a damper width;

(h) an inner surface defining a cavity;

(i) first and second ends, wherein said first and second ends are formed by said inner surface in contact with itself in at least a first and second contact area such that said contact areas form seals, further wherein said first and second ends do not substantially exceed said damper width, further wherein said contact areas substantially form a W-shape.

14. A fuel pressure damper according to claim 13, wherein said contact areas that substantially form a W-shape are flattened.

15. A fuel pressure damper according to claim 14, wherein said flattened contact areas are sealed by soldering.

16. A fuel pressure damper according to claim 14, wherein said flattened contact areas are sealed by crimping.

17. A fuel pressure damper according to claim 14, wherein said flattened contact areas are sealed by welding.

18. A fuel pressure damper according to claim 14, wherein said flattened contact areas are sealed by adhesive.

* * * * *